United States Patent [19]

Bowes et al.

[11] 4,285,742

[45] Aug. 25, 1981

[54] HEAT TREATMENT METHOD

[75] Inventors: Robert G. Bowes, Otley; Robert D. Chapman, Harrogate, both of England

[73] Assignee: BOC Limited, London, England

[21] Appl. No.: 98,577

[22] Filed: Nov. 29, 1979

[51] Int. Cl.[3] ..... C21D 1/48

[52] U.S. Cl. ..... 148/16; 148/20.3

[58] Field of Search ..... 148/16.5, 16.6, 16.7, 148/20.3, 16.0

[56] References Cited

U.S. PATENT DOCUMENTS

| | | | |
|---|---|---|---|
| 2,673,821 | 3/1954 | Stutzman | 148/16.5 |
| 2,875,113 | 2/1959 | Fitz | 148/16.7 |
| 4,049,472 | 9/1977 | Arndt | 148/16 |
| 4,139,375 | 2/1979 | Solomon et al. | 148/16.7 |
| 4,154,629 | 5/1979 | Asai et al. | 148/16.6 |

*Primary Examiner*—L. Dewayne Rutledge
*Assistant Examiner*—John P. Sheehan
*Attorney, Agent, or Firm*—David L. Rae; Larry R. Cassett

[57] ABSTRACT

In order to decarburize ferrous metal without recourse to an exothermic generator, an inert gas (typically nitrogen), water and a liquid or vaporous compound of carbon, hydrogen and oxygen (typically methanol) are admitted to a working chamber of the heat treatment furnace in which the metal is situated. The decarburization is preferably performed at 700° to 800° C. The methanol and water react to form a non-oxidizing, decarburizing atmosphere at the decarburizing temperature. The metal may be oxidized at a temperature below 600° C. in another chamber of the furnace, the atmosphere from the decarburizing chamber being passed into the oxidizing chamber.

10 Claims, No Drawings

HEAT TREATMENT METHOD

This invention relates to a heat treatment method. In particular it relates to a method of decarburising ferrous metal.

Decarburisation of ferrous metal (typically steel) is a process of heat treatment which, for example, is employed in making electrical or magnetic components. The removal of carbon enhances the electrical and magnetic properties of steel. In one example of the process, laminated steel plates are decarburised. Their surfaces are then oxidised to form an electrically insulative blue oxide film. The laminated steel plates are then used to form the cores of electrical transformers.

The decarburisation is performed by subjecting the steel at elevated temperature to a suitable atmosphere. The atmosphere commonly used is prepared in a generator outside the heat treatment furnace. Typically an exothermic generator is used. It is operated so as to give a so called rich "exothermic" mixture. Such a mixture typically contains about 70% by volume of nitrogen, and smaller amounts of carbon monoxide, carbon dioxide and water vapour. The amounts of carbon dioxide and water vapour present in the exothermic mixture are sufficient to make the atmosphere decarbursing.

Exothermic generators suffer from a number of disadvantages. They require regular maintenance, and tend to be uneconomic if operated intermittently. In addition, they occupy floor space which could used in other more profitable ways.

An object of the present invention is to provide a method of decarburising which employs an atmosphere containing nitrogen but which avoids the use of an exothermic generator.

According to the invention there is provided a method of de-carburising ferrous metal, comprising the steps of introducing the ferrous metal to be decarburised into a working chamber of a heat treatment furnace, raising the ferrous metal to a temperature at which decarburisation is able to take place, and establishing in the working chamber a decarburising atmosphere by admitting into the chamber inert gas, water and a liquid or vaporous compound of carbon, hydrogen and oxygen, the relative proportions of water and the compound of carbon, hydrogen and oxygen being such that at the prevailing temperature in the working chamber the atmosphere established therein decarburises the ferrous metal without forming oxide of the ferrous metal.

By the term "inert gas" as used herein is meant gas which is not any one of the following: an oxidising agent, a reducing agent, a carburising agent and a decarburising agent.

The inert gas is preferably nitrogen. Typically, the nitrogen is introduced into the working chamber of the furnace as a gas formed by vaporising liquid nitrogen. It is not essential to use nitrogen as the inert gas. One of the noble gases, such as argon, may be used instead of or in addition.

The compound of carbon, hydrogen and oxygen is preferably one that cracks at the decarburising temperature to form carbon monoxide and hydrogen. These may be the only products of the cracking or decomposition of the compound of carbon, hydrogen and oxygen or, less preferably, methane or other hydrocarbons may be formed in addition. Preferably, the compound of carbon, hydrogen and oxygen is methanol.

It is possible to use, in addition or alternatively to methanol, a higher aliphatic alcohol. It is also possible to use acetone in addition or alternatively to methanol.

The compound of carbon, hydrogen and oxygen may be vaporised before being admitted to the working chamber of the furnace. The vapour so-formed may if desired be mixed with the inert gas upstream of the working chamber. An alternative is simply to introduce the compound of carbon, hydrogen and oxygen into the working chamber as a liquid. This may be achieved by dripping the compound into the working chamber of the furnace. Generally, furnaces employed for decarburising metal have relatively large working chambers. It is desirable to vaporise both the organic liquid (ie. compound of carbon, hydrogen and oxygen) and the water, before admitting these compounds to the furnace. In small furnaces, the water may be introduced into the working chamber of the furnace as a liquid. It too may be dripped into the working chamber. If desired, the water and compound of carbon, hydrogen and oxygen may be pre-mixed.

The optimum relative proportions of water and the compound of carbon, hydrogen and oxygen depend on the composition of the compound of carbon, hydrogen and oxygen and the temperature selected for de-carburising. What is necessary is that the relative proportions of water and the compound of carbon, hydrogen and oxygen should be such as to prevent the formation of iron oxide at the decarburising temperature. Preferably, the decarburising temperature is from 700°-800° C. At 800° C. the relative proportions of the compound of carbon, hydrogen and oxygen and water should be such that in the furnace atmosphere the ratio of hydrogen to water is at least two to one by volume and the ratio of carbon monoxide to carbon dioxide, by volume, is at least 1.8 to 1. At higher decarburising temperatures a lower hydrogen to water ratio may be tolerated, but a higher carbon monoxide to carbon dioxide ratio will generally be required. At 700° C., the relative proportions of water and the compound of carbon, hydrogen and oxygen are preferably such that the ratio by volume of hydrogen to water vapour in the furnace atmosphere is at least 2.5 to 1 and the ratio by volume of carbon monoxide to carbon dioxide in the furnace atmosphere is at least 1.5 to 1. Below 700° C., it would be desirable to use a hydrogen to water ratio greater than 2.5 to 1. It may be possible, however, to use a lower carbon monoxide to carbon dioxide ratio at a temperature below 700° C.

Although the chosen decarburising temperature is preferably from 700° C. to 800° C., it is possible to decarburise at a temperature in the range 600°-1120° C.

If methanol is the compound of carbon, hydrogen and oxygen, the reactions that take place in the working chamber of the furnace to the various constituents of the atmosphere are as follows:

$$CH_3OH = CO + 2H_2$$

$$CH_3OH + CO = CH_4 + CO_2$$

$$H_2O + CO = CO_2 + H_2$$

At 800° C. the first and third reactions tend to predominate, but the second reaction, we believe, becomes more significant at progressively lower temperatures. Thus, although we believe the preferred decarburising temperature range to be 700°-800° C., we believe that with methanol the optimum decarburising temperature lies in the upper region of this range.

Inert gas is preferably admitted to the working chamber of the furnace at sufficient rate to make it the predominant constituent of the resulting atmosphere. Preferably, it is admitted at such a rate that the furnace atmosphere contains at least 50% by volume of inert gas and most preferably at least 70% by volume of inert gas.

Typically, the atmosphere formed in the working chamber may have the following composition by volume:

Carbon monoxide—3 to 8%
Carbon dioxide—2 to 6%
Hydrogen—6 to 16%
Water vapour—1 to 5%
Nitrogen balance (typically 70–75%)

Preferably, the atmosphere formed in the furnace contains at least 15% by volume of hydrogen.

If, after the decarburisation has been effected, it is desired to oxidise the surface of the work, the same atmosphere used for decarburisation may be employed to effect the oxidation at a lower temperature. Typically, the oxidation is performed at a temperature below 600° C. If the oxidation is performed in a continuous heat treatment furnace, the work may be advanced through a decarburising chamber into an oxidation chamber. The atmosphere may be similarly passed from the decarburising chamber to the oxidation chamber. Typically, the oxidation chamber is maintained at a temperature below 600° C. and the decarburisation chamber at a temperature in the range of 700°–800° C. It is of course possible to decarburise first in a batch furnace and then oxidise in that furnace.

Oxidation may be required for making cores of transformers and electric motors. Typically, the surfaces of steel plates are given a blue oxide film after being decarburised.

The precise rates at which the inert gas, water and compound of carbon, oxygen and hydrogen are admitted to the working chamber of the furnace may be determined by simple experiment. Typically, once suitable rates have been determined, metering valves controlling the supply of the inert gas, water and compound of carbon, oxygen and hydrogen may be set so as always to give the desired atmosphere. It is possible, however to control the admission of the various fluids automatically. For example, the hydrogen to water vapour and carbon monoxide to carbon dioxide ratios may be measured by means of suitable instruments and the outputs from these instruments passed into a programmer which controls valves in the pipelines from which the inert gas, water and the compound of carbon, hydrogen and oxygen are supplied so as always to keep the hydrogen to water and carbon monoxide to carbon dioxide ratios within chosen ranges.

The method according to the invention will now be illustrated by the following example.

EXAMPLE

Dry nitrogen was admitted to the working chamber of an Efco GVRT3 sealed quench furnace (a small furnace suitable for experimental work) at a rate of 100 cubic feet per hour. Heating of the working chamber was initiated so as to raise its temperature from ambient. When the temperature of the furnace had reached a chosen working temperature, methanol and water were dripped separately into the working chamber. The methanol was added at a rate of 0.65 liters per hour, and the water at a rate of 0.21 liters per hour. After an hour at the working temperature, the work comprising small plates of steel containing 0.05% by weight of carbon were loaded into the working chamber of the furnace. The steel plates were held in the working chamber at the working temperature for a period of two hours throughout which time nitrogen, methanol and water were supplied to the furnace at the aforementioned rates.

After two hours the work was transferred to the vestibule of the furnace. At the same time, the atmosphere from the working chamber of the furnace was allowed to flow into the vestibule. When the work had cooled to ambient temperature (this taking one hour) it was unloaded from the vestibule.

The steel plates withdrawn from the vestibule were found to have a surface film of oxide mid-blue in colour. The plates were examined spectrographically for carbon.

Three experiments were performed, at (a) 800° C., (b) 750° C. and (c) 700° C. respectively.

The results are shown in the table below. The analysis of the furnace atmosphere was made at the end of the two hour decarburisation period. In experiment (c), the $CO/CO_2$ ratio is below 1.5. This accounts for the higher proportion of carbon in the laminations.

At 750° C. for decarburisation, the ratio of methanol to water may typically be in the range 3:1 to 1.5:1 and the ratio of nitrogen to methanol in the range 2.33:1 to 1:3. These ratios are in terms of parts by (gaseous) volume at 750° C.

TABLE I

FURNACE CONDITIONS AT COOL OUT

| | Atmosphere Analysis | | | | | | |
|---|---|---|---|---|---|---|---|
| Temp. °C. | CO % by vol | $CO_2$ % by vol | $H_2$ % by vol | $CH_4$ % by vol | Dew Point °C. | $O_2$ mV | Carbon in Laminations by weight % |
| 800 | 7.1 | 2.8 | 13 | .85 | 20 | 975 | .004 |
| 750 | 7.4 | 2.1 | not measured | 1.2 | 18 | 980 | .005 |
| 700 | 5.1 | 3.5 | 9 | 2.7 | 20 | 990 | .006 |

What is claimed is:

1. A method of decarburising ferrous metal comprising the steps of introducing the ferrous metal to be decarburised into a working chamber of a heat treatment furnace, raising the ferrous metal to a temperature at which decarburisation is able to take place, and establishing in the working chamber a decarburising atmosphere by admitting into the chamber inert gas, water and a compound of carbon, hydrogen and oxygen, the relative proportions of water and the compound of carbon, hydrogen and oxygen being such that at the prevailing temperature in the working chamber the atmosphere established therein contains at least about 1% water vapor and decarburises the ferrous metal without forming oxide of the ferrous metal.

2. A method as claimed in claim 1, in which the inert gas is nitrogen.

3. A method as claimed in claim 1, in which the compound of carbon, hydrogen and oxygen cracks in the furnace to form carbon monoxide and methane.

4. A method as claimed in claim 3, in which the compound of carbon, hydrogen and oxygen is methanol.

5. A method as claimed in claim 1, in which the compound of carbon, hydrogen and oxygen and the water are vaporised before being admitted to the working chamber of the furnace.

6. A method as claimed in claim 2, in which the decarburisation is performed in the temperature range 700° to 800° C.

7. A method as claimed in claim 3, which the inert gas is admitted to the furnace at such a rate that the said atmosphere contains at least 50% by volume of inert gas.

8. A method as claimed in claim 1, in which the surface of the metal is oxidised after decarburisation, the oxidation being performed at below 600° C.

9. A method as claimed in claim 8, in which the oxidation is performed in a different working chamber of the furnace from that in which the decarburisation is performed, the atmosphere from the decarburising chamber being passed into the oxidation chamber.

10. A method of decarburising ferrous metal comprising the steps of introducing said ferrous metal into a working chamber of a heat treatment furnace; heating the working chamber to a temperature between 600°-1120° C.; introducing nitrogen, water and a compound of carbon, oxygen and hydrogen into a working chamber to form therein a decarburising atmosphere comprised of approximately by volume 3-8% carbon monoxide, 2-6% carbon dioxide, 6-16% hydrogen, 1-5% water vapour, balance nitrogen; and retaining said ferrous metal in said working chamber for a time sufficient to decarburise said ferrous metal without forming oxide of said ferrous metal.

* * * * *